United States Patent [19]

Easton et al.

[11] Patent Number: 4,854,938

[45] Date of Patent: Aug. 8, 1989

[54] REMOVAL OF WATER HAZE FROM DISTILLATE FUEL

[75] Inventors: Thomas Easton; Bryan Thomas, both of Barry, Wales

[73] Assignee: Dow Corning, Ltd., Barry, Wales

[21] Appl. No.: 187,186

[22] Filed: Apr. 28, 1988

[30] Foreign Application Priority Data

May 8, 1987 [GB] United Kingdom ..... 8710888

[51] Int. Cl.[4] ..... C10L 1/28

[52] U.S. Cl. ..... 44/56; 44/67; 44/72; 44/75; 44/76; 208/188

[58] Field of Search ..... 44/56, 67, 72, 75, 76; 208/188

[56] References Cited

U.S. PATENT DOCUMENTS

| | | | |
|---|---|---|---|
| 2,476,308 | 7/1949 | Klein | 252/312 |
| 2,992,083 | 7/1961 | Bluestein et al. | 44/72 |
| 3,249,535 | 5/1966 | Keil | 252/8.3 |
| 3,485,603 | 12/1969 | Balash | 44/63 |
| 4,002,558 | 1/1977 | Feldman | 208/188 |
| 4,059,581 | 11/1977 | Prokai | 544/69 |
| 4,131,433 | 12/1978 | Scott | 44/51 |
| 4,183,820 | 1/1980 | Heinz et al. | 252/342 |
| 4,381,241 | 4/1983 | Romenesko et al. | 252/8.5 P |
| 4,460,380 | 7/1984 | Rehrer | 44/62 |
| 4,690,688 | 9/1987 | Adams et al. | 44/76 |

FOREIGN PATENT DOCUMENTS

| | | |
|---|---|---|
| 2250920 | 10/1972 | Fed. Rep. of Germany . |
| 1003062 | 9/1965 | United Kingdom . |

*Primary Examiner*—William R. Dixon, Jr.
*Assistant Examiner*—Jerry D. Johnson
*Attorney, Agent, or Firm*—Alexander Weitz

[57] ABSTRACT

A method of de-hazing distillate fuel is disclosed which comprises adding to the fuel a solution of a halide salt dissolved in an alcohol, and an alcohol soluble organosiloxane. The halide salt may be the chloride of magnesium, cadmium, copper, nickel or the tetra methyl ammonium group, for example the salt may have the formula $MgCl_2.6H_2O$ or $(CH_3)_4NCl$. The organosiloxane may be a cyclic, linear or branched material and may have e.g. a minor amount of siloxane units having the general formula $$R_aSiO_{\frac{(3-a)}{2}} \quad \text{(i)}$$

and a minor amount of siloxane units having the general formula $$R_bZ_cSiO_{\frac{((3-(b+c))}{2}} \quad \text{(ii)}$$

in which each R represents a substituted or unsubstituted hydrocarbon group of up to ten carbon aotms, a has the value 0, 1, 2, or 3, b has the value 0, 1 or 2, c has the value 1 or 2, and each Z represents a group linked to the silicon atom and comprising a functional organic group. Each group Z may be a group selected from the polyoxyalkylene group $R'(OCH_2CH_2)_p(OCH_2CH.CH_3)_2OR''$, the amine group $R'NHQ$, the quaternary ammonium salt $R'NR_3X$, the carboxylate group $R'CO_2$, the sulphonate group $R'SO_3M$, or the hydroxyl group, in which R' represents a group which provides a link to the silicon atom through an oxygen or a carbon atom, p has a vlaue in the range 1 to 100, r has a value in the range 0 to 50, the sum of p and q is in the range 2 to 100, R'' represents a hydrogen atom, an alkyl group or an acyl group, Q represents a hydrogen atom or a group $R'NHQ$, each $R^2$ represents an alkyl group, X represents a halide ion and each group M represents a cation.

27 Claims, No Drawings

REMOVAL OF WATER HAZE FROM DISTILLATE FUEL

This invention is concerned with removal of water haze from distillate fuel.

By the expresion "distillate fuel" where used herein, we mean distilled hydrocarbon fuels which boil in the range of about 70° C. to about 500° C. The distillate fuel may comprise atmospheric distillate or cracked gas oil or a blend of straight run or cracked distillates with or without additives, e.g. benzole or tetraethyl lead, or freezing point depressants. The common distillate fuels are motor spirit, kerosene, jet fuel and diesel fuel.

Distillate fuels usually contain a minor amount of water i.e. about 100 to 300 parts of water per million parts of the fuel. Water is present in an aqueous phase in most fuel storage tanks and it is very difficult to ensure the fuel does not contain water. The water manifests itself as a haze in the liquid fuel. Presence of the haze in the fuel is regarded as technically unsatisfactory, for example, in view of the possibility of the water to coalesce slowly during storage and so provide a source of corrosion of storage vessels and pipes and in view of the possibility of the water to form ice at lower temperatures of use and thus interfere with supply of the fuel through supply pipes. The haze is also regarded as unsatisfactory from the aesthetic point of view.

It has been proposed to accelerate clearance of the haze by use of additives. For example, U.S. Pat. No. 4,002,558 discloses a method for removing water haze from a middle distillate fuel which comprises contacting the fuel with a specified amount of a solution of an inorganic halide or nitrate of calcium, magnesium, cadmium, copper or nickel in a fuel immiscible aliphatic monohydric alcohol, polyhydric alcohol or glycol ether. The preferred additive composition referred to in the specification is a solution of $MgCl_2.6H_2O$ dissolved in methanol.

U.S. Pat. No. 4,460,380 discloses the use of certain block copolymers of organosiloxane and polyoxyalkylene oxide for separating out or otherwise reducing water haze in middle distillate petroleum fuels. Block copolymers employed in the examples of the patent include a primary hydroxyl functional polydimethylsiloxane polyoxyethylene copolymer commercially available as Dow Corning ® Q4-3667.

We have now found that excellent de-hazing may be achieved by use of simple halide salts in conjunction with substituted orunsubstituted polydiorganosiloxanes.

The present invention provides in one of its aspects a method of de-hazing distillate fuel which comprises adding to the fuel a solution of a halide salt dissolved in an alcohol, and an alcohol soluble organosiloxane.

A method according to the present invention is applicable to distillate fuels in general and in particular is beneficial in respect of diesel fuel. By the expression "diesel fuel" where used herein is meant gas oil and fuel oil including those materials which are referred to as light domestic and heating oils and diesel fuel and irrespective of whether they are intended for vehicular, marine, heating or other use. These materials are loosely characterised as having a viscosity of not more than 115" Redwood 1 at 38° C. and a boiling point in the range of about 200° C. to about 380° C. Particularly embraced within the expression are those hydrocarbon liquids having a viscosity of about 30 to about 40" Redwood 1 at 38° C. including those having a viscosity at 20° C. in the range of about 2.9 to about 10.2 centistokes and at 38° C. in the range of about 1.6 to about 6.0 cS.

In a method according to the invention the distillate fuel is preferably a diesel fuel used as a fuel for motor vehicles, e.g. cars and heavy goods vehicles, as a heating fuel or as a marine engine fuel. However, a method according to the invention may also find use, at least to a limited extent, for de-hazing of other distillate fuels, for example, motor spirit i.e. light oil distilling between 70° C. and 200° C. and treated to reach an octane number (RON) >85, aviation spirit, fuels for jet engines, residual fuel oils having a viscosity at 38° C. of greater than 115" Redwood 1, light medium and heavy naphthas and vapourising oils.

Distillate fuels frequently contain additives intended to enhance various properties of the fuel but which under some conditions may serve to stabilize haze in the fuel. Additives may be present for example as wax crystal modifiers, pour point depressants, cold flow improvers, or viscosity modifiers. Materials often present as additives in diesel fuel include, for example, copolymers of ethylene with unsaturated esters e.g. vinyl acetate, vinyl butyrate, various acrylates and fumarates, polymeric esters of higher olefins and unsaturated alkyl esters, amine salts and amides.

The halide salt and the organosiloxane together provide a de-hazing agent. The optimum choice of de-hazing agent for a particular distillate fuel varies from distillate fuel to distillate fuel and appears to depend on characteristics of the oily and aqueous phases. The effectiveness of de-hazing agents under field operating conditions is not readily predictable, but may be ascertained by a simple testing procedure. Thus, samples of the de-hazing agent may be mixed with a selected distillate fuel, the mixture shaken and blended. At intervals, the light transmittance properties of samples of the fuel may be determined and thus a measure of the effectiveness of the de-hazing agent may be found. Some de-hazing agents according to the invention are more effective for de-hazing fuels containing additives than are others.

In a method according to the invention, the halide salt is employed as a solution in an alcohol. The choice of halide ion does not appear to be critical, whereas it is important that the salt be alcohol soluble in order that the salt may be incorporated readily into the distillate fuel. It is therefore important to select as the halide salt a material which is soluble in one or more of the commonly available alcohols e.g. methanol, ethanol, isopropanol, ethylene glycol. The useful halides include the chlorides and bromides of magnesium, cadmium, copper, nickel and the tetra methyl ammonium group. In order to secure suitable solubility and/or effectiveness of the salts it is sometimes desirable to employ the salts in the form of their hydrates. Preferred materials are $MgCl_2.6H_2O$ and $(CH_3)_4NCl$. The former is preferred when the organosiloxane is a cationic material or a non-ionic material; the latter is preferred when the organic organosiloxane is an anionic material, because the divalent cation $Mg^{++}$ causes gelling of the organosiloxane, and may also be employed with the non-ionic organosiloxanes.

In a method according to the invention, there appears no restriction on the nature of the siloxane which may be used provided that it can be dissolved in an alcohol in which the salt can be dissolved. The organosiloxane may be added to the fuel separately, undiluted or as a solution in an alcohol in which the salt is soluble, or it may be included in the solution containing the salt.

Compatibility and solubility of the organosiloxane in organic solvents, for example alcohols and distillate fuel is influenced by organo substituents of the organosiloxane and by the molecular size of the organosiloxane. The organosiloxane may have a consistency from a mobile liquid to a waxy solid, provided that it has at least limited solubility in the alcohol. Preferably the organosiloxane has 2 to 2000 silicon atoms. The organosiloxane is preferably dissolved in the same alcohol as the halide salt so that the siloxane and the halide salt may be introduced to the distillate fuel as a single solution in the alcohol. The commonly available polysiloxanes are capable of acting to enhance performance of the halide salts to provide de-hazing agents of superior performance. The organosiloxane may be non-ionic, cationic or anionic and may be, for example, a polydiorganosiloxane, a block copolymer of an organosiloxane and a polyoxyalkylene glycol or a polydiorganosiloxane having functional organic substituent groups. The organosiloxanes used in a method according to the invention may include units having the general formula $$R_aSiO_{\frac{(3-a)}{2}} \quad \text{(i)}$$

in which each R represents a substituted or unsubstituted hydrocarbon group of up to ten carbon atoms and a has the value 0, 1, 2, or 3, the units (i) thus being present as chain units, chain branching units or terminal units of the organosiloxane molecule. The group R is preferably an unsubstituted alkyl, aryl, alkaryl, aralkyl or cycloaliphatic group. The most preferred groups are the lower alkyl groups, for example methyl, ethyl and propyl and the phenyl group. Preferably not less than 80% of the groups R are methyl. The organosiloxane may comprise units having the general formula $$R_bZ_cSiO_{\frac{((3-(b+c))}{2}} \quad \text{(ii)}$$

in which each R is as defined above, b has the value 0, 1 or 2, and c has the value 1 or 2. The value of b is preferably 1 or 2, the value of c is preferably 1 or 2 and the units (ii) are preferably present as chain units or terminal units of the organosiloxane molecule. Each Z represents a group linked to the silicon atom and comprising a functional organic group. Each Z may represent, for example, a polyoxyalkylene group $R'(OCH_2CH_2)_p(OCH_2CH.CH_3)_rOR''$, an amine R'NHQ, a quaternary ammonium salt $R'NR^2{}_3X$, a carboxylate group $R'CO_2M$, a sulphonate group $R'SO_3M$, or a hydroxyl group. R' represents a group which provides the link to the silicon atom through an oxygen or a carbon atom and may be, for example, a divalent linear or branched hydrocarbon group, for example an alkylene group according to the formula $—(CH_2)_n—$where n has a vlaue in the range 2 to 10, p may have a value in the range 1 to 100 for example, and r may have a value in the range 0 to 50 for example, with the sum of p and q being in the range 2 to 100. R'' may represent a hydrogen atom, an alkyl or an acyl group. Q may represent, for example, a hydrogen atom or a group R'NHQ. Each $R^2$ represents an alkyl group and they may be the same or different and may have for example up to 20 carbon atoms. Preferably, two of the groups $R^2$ have 1 to 5 carbon atoms, for example the methyl or ethyl groups, and one of the groups $R^2$ has a chain of 10 to 15 carbon atoms. X represents a halide ion which may be any of those commonly available, for example, iodide or chloride. Each group M represents a cation, for example a sodium ion.

The organosiloxane may be a cyclic, linear or branched material and may be composed exclusively of units (i) or units (ii) or may be composed of units (i) and units (ii), for example a major amount of units (i) and a minor amount of units (ii), and the units may be arranged at random or in blocks. Organosiloxanes suitable for use in the present invention may be made by methods known in the art.

In a method according to the invention the de-hazing agent may be incorporated into the distillate fuel in any convenient way e.g. via a metering device and may be introduced as one solution or in separate parts. The de-hazing agents are effective to accelerate de-hazing of the fuel when stirred or otherwise mixed into the fuel. They may also be effective de-hazers when applied on the surface of the fuel and allowed to spread on the surface of the fuel and diffuse into the body of the fuel. The amount introduced may be determined on a trial basis, but normally is not more than about 500 parts de-hazing agent per million parts fuel by volume. The de-hazing agent may be introduced as sole de-hazer or may be introduced in conjunction with other materials, for example, organic dehazers of known type.

By use of a method according to the invention an enhanced de-hazing effect may be achieved. We have been able to de-haze some distillate fuels to a greater extent than was previously achieved.

In order that the invention may become more clear, there now follows a description of examples selected to demonstrate the inventio. In the examples all parts are by volume unless otherwise stated. The symbol Me represents the methyl group. In the examples, tests 4, 6, 8, 10, 14, 16, 18, 22, 24, 28, 30, 32, 36, 37, 38, 42, 44, 45, 52, 56 and 58 are regarded as illustrative of the invention.

In the Examples, the performance of various materials as de-hazers for distillate fuel was compared. In Examples 1 to 5 the comparisons were made using samples taken from test batches prepared by mixing portions of diesel fuels with 0.1% distilled water using a high shear mixer. Stirring of the mixture in the high shear mixer was continued for 5 minutes in order to produce a batch of diesel fuel containing a stable haze. To portions of these batches, the desired amount of the material under evaluation as dehazing agent was introduced as a 10% solution in methanol to provide the test batches. In Example 6 the comparisons were made using samples taken from test batches prepared by mixing portios of motor spirit and 0.008% distilled water using a high shear mixer to produce a batch of motor spirit containing a stable haze. To these batches, de-hazing agents were introduced to the extent of 50 parts de-hazing agent per million parts motor spirit. In each Example, periodically, samples were removed from the test batches, charged into clear glass containers and their light transmittance measured using a WPA CO65 colorimeter. The proportion of incident light transmitted through each sample was recorded as a percentage. As the haze cleared the proportion of light transmitted increased. No haze was visible to the naked eye when the light transmittance had increased to about 97%. Preparation of the batches and testing of the samples were all undertaken at room temperature, i.e. 22° C.

The materials evaluated as de-hazing agents were as follows.

Material A was $MgCl_2.6H_2O$.

Material B was $MgBr_2.6H_2O$.

Material C was $Mg(NO_3)_2$.

Material D was $Me_4NCl$.

Material E was $(CH_3(CH_2)_{7-9})N^+Me_3Cl^-$.

Material F was $(CH_3(CH_2)_{15})N^+Me_3\ Cl^-$.

Material G was octamethyl trisiloxane having a viscosity of 1 $mm^2/s$.

Material H was dodecamethyl pentasiloxane having a viscosity of 2 $mm^2/s$.

Material I was a polydiorganosiloxane polyoxyethylene glycol block copolymer comprising a centre block of about 15 dimethylsiloxane units and two hydroxyl terminated polyoxyethylene dimethyl silyl end blocks, each polyoxyethylene chain having about 10 to about 20 oxyethylene units and a hydroxyl cap.

Material J was a polydiorganosiloxane quaternary ammonium salt having the general formula $$Me_3SiO(Me_2SiO)_6(MeSiOR'N^+(R_2)_3I^-)_2SiMe_3$$

in which R' was $-(CH_2)_3-$, two groups $R^2$ were methyl and one was an alkyl group having 12 to 14 carbon atoms.

Material K was a silicone glycol copolymer having trimethylsilyl end blocks, dimethylsiloxane units and methyl polyalkylene glycol siloxane units and a viscosity at 25° C. of about 1500 $mm^2/s$. Each polyalkylene chain contained about 18 oxyethylene units and about 18 oxypropylene units and the chain had an acetate cap.

Material L was a polydiorganosiloxane quaternary ammonium salt having the general formula $$Me_3SiO(Me_2SiO)_7(MeSiOR'N^+(R^2)_3Cl^-)_4SiMe_3$$

in which R' was $-(CH_2)_3-$, two groups $R^2$ were methyl and one was an alkyl group having 12 to 14 carbon atoms.

Material N was an aminopolydiorganosiloxane having the general formla $$Me_3SiO(Me_2SiO)_{49}(Me(Z')SiO)SiMe_3$$

in which Z' was $-CH_2CH(CH_3)CH_2NHCH_2CH_2NH_2$.

Material P was a silicone glycol copolymer having trimethylsilyl end blocks, dimethylsiloxane units and methyl polyalkylene glycol siloxane units and a viscosity at 25° C. of about 2000 $mm^2/s$. Each polyalkylene chain contained about 18 oxyethylene units and about 18 oxypropylene units and the chain had an acetate cap.

Material S was a polydiorganosiloxane carboxylate salt having the general formula $$Me_3SiO(Me_2SiO)_{90}(Me(Z')SiO)_{10}SiMe_3$$

in which Z' was $-(CH_2)_{10}COO^-Na^+$.

Material T was a silicone glycol copolymer having trimethylsilyl end blocks, dimethylsiloxane units and methyl polyethylene glycol siloxane units and a viscosity at 25° C. of about 250 $mm^2/s$. Each polyethylene chain contained about 12 oxyethylene units and the chain had an acetate cap.

The materials were tested alone and in combination in different distillate fuels as discussed in the following Examples.

EXAMPLE I

Samples were prepared and tested as referred to above, using as the distillate fuel a commercial vehicle fuel supplied as Fina diesel. The amounts of the materials under evaluation which were added per million parts of fuel are shown in parenthesis in Table I. The light transmittance was determined after 0, 24, 48 and 72 hours. The results are recited in Table I. From this Table it can be seen that with this fuel, the haze cleared reasonably quickly with no additive. With added siloxane alone, the haze cleared more slowly whereas the haze in the sample treated with the salt alone cleared more quickly, and the haze in the samples treated with the mixtures of halide salt and organosiloxane cleared more quickly than that of the samples treated with the salt alone.

TABLE I

| | | Percentage Light Transmittance After | | | |
|---|---|---|---|---|---|
| Test | Material Added | 0 | 24 | 48 | 72 hours |
| 1 | None | 36 | 74 | 80 | 90 |
| 2 | A (100) | 36 | 74 | 88 | 98 |
| 3 | G (100) | 36 | 55 | 64 | 68 |
| 4 | A (100) G (100) | 36 | 82 | 86 | 99 |
| 5 | I (100) | 38 | 70 | 76 | 82 |
| 6 | A (100) I (100) | 45 | 87 | 98 | 100 |
| 7 | J (100) | 34 | 68 | 74 | 83 |
| 8 | A (100) J (100) | 41 | 87 | 94 | 97 |
| 9 | K (100) | 38 | 65 | 72 | 79 |
| 10 | A (100) K (100) | 36 | 82 | 88 | 95 |

EXAMPLE II

Samples were prepared and tested as referred to above, using as the distillate fuel a commercial vehicle fuel supplied as Gulf diesel. The amounts of the materials under evaluation which were added per million parts of fuel are shown in parenthesis in Table II. The light transmittance was determined after 0, 24, 48 and 96 hours. The results are recited in Table II. From this Table it can be seen that with this fuel, the haze was very stable and difficult to clear. The haze cleared most quickly from samples treated with Test materials 15 and 18.

TABLE II

| | | Percentage Light Transmittance After | | | |
|---|---|---|---|---|---|
| Test | Material Added | 0 | 24 | 48 | 96 hours |
| 11 | None | 26 | 64 | 74 | 82 |
| 12 | A (100) | 24 | 60 | 71 | 81 |
| 13 | G (100) | 28 | 64 | 74 | 82 |
| 14 | A (100) G (100) | 25 | 68 | 78 | 86 |
| 15 | J (100) | 26 | 80 | 94 | 95 |
| 16 | A (100) J (100) | 24 | 63 | 73 | 86 |
| 17 | K (100) | 25 | 68 | 78 | 86 |
| 18 | A (100) K (100) | 24 | 74 | 86 | 92 |

EXAMPLE III

Samples were prepared and tested as referred to above, using as the distillate fuel a commercial vehicle fuel supplied as Esso diesel to which was added 0.1% by weight of detergent additive composition including materials effective as detergents, cold flow improvers, viscosity modifiers, or the like and which has the characteristic of stabilising the haze. The amounts of the materials under evaluation which were added per million parts of fuel are shown in parenthesis in the Tables.

The light transmittance was determined after 0, 24, 48 and 120 hours. The results are recited in Tables III and IV. From these Tables it can be seen that with this fuel, the haze was stable and cleared slowly in absence of a de-hazing agent. Some of the organosiloxanes appeared to stabilize the haze, whilst some gave a modest improvement in clearing the haze. The haze cleared more quickly and to a greater extent from the samples containing the magnesium halide salt, but not as quickly as from those containing the salt - siloxane mixtures. The haze cleared most effectively from samples treated with Test materials 22, 24, 30 and 32.

TABLE III

| Test | Material Added | Percentage Light Transmittance After | | | |
|---|---|---|---|---|---|
| | | 0 | 24 | 48 | 120 hours |
| 19 | None | 25 | 20 | 26 | 39 |
| 20 | A (100) | 28 | 45 | 60 | 92 |
| 21 | G (100) | 22 | 13 | 22 | 27 |
| 22 | A (100) G (100) | 26 | 73 | 87 | 99 |
| 23 | H (100) | 22 | 12 | 13 | 15 |
| 24 | A (100) H (100) | 26 | 64 | 79 | 99 |

TABLE IV

| Test | Material Added | Percentage Light Transmittance After | | | |
|---|---|---|---|---|---|
| | | 0 | 24 | 48 | 120 hours |
| 25 | None | 25 | 20 | 28 | 42 |
| 26 | A (100) | 27 | 25 | 36 | 64 |
| 27 | L (100) | 27 | 33 | 58 | 88 |
| 28 | A (100) L (100) | 33 | 67 | 76 | 91 |
| 29 | N (100) | 25 | 20 | 24 | 41 |
| 30 | A (100) N (100) | 31 | 74 | 84 | 100 |
| 31 | P (100) | 23 | 12 | 14 | 17 |
| 32 | P (100) A (100) | 31 | 76 | 86 | 97 |

EXAMPLE IV

This sample shows the effectiveness of Material D in conjunction with anionic and other organosiloxanes. Samples were prepared and tested as referred to above, using as the distillate fuel a commercial vehicle fuel supplied as Esso diesel to which was added 0.1% by weight of the detergent additive used in Example III. The amounts of the materials under evaluation which were added per million parts of fuel are shown in parenthesis in the Tables. The results are recited in Tables V and VI. From these Tables it can be seen that with this fuel, the haze was stable and cleared slowly in absence of a de-hzaing agent. The haze cleared most quickly and to a greater extent from the samples containing the halide salt siloxane mixtures, and especially that containing 100 ppm of Material D and 20 ppm of Material S. The haze cleared most effectively from samples treated with Test materials 36 and 42.

TABLE V

| Test | Material Added | Percentage Light Transmittance After | | | |
|---|---|---|---|---|---|
| | | 0 | 24 | 48 | 96 hours |
| 33 | None | 11 | 14 | 20 | 31 |
| 34 | D (100) | 13 | 16 | 29 | 39 |
| 35 | S (100) | 10 | 20 | 28 | 39 |
| 36 | D (100) S (20) | 19 | 77 | 90 | 94 |
| 37 | D (100) S (100) | 17 | 75 | 84 | 89 |
| 38 | D (100) S (200) | 13 | 53 | 70 | 78 |

TABLE VI

| Test | Material Added | Percentage Light Transmittance After | | |
|---|---|---|---|---|
| | | 0 | 72 | 120 hours |
| 39 | None | 23 | 21 | 49 |
| 40 | D (100) | 29 | 64 | 88 |
| 41 | K (100) | 16 | 18 | 36 |
| 42 | D (100) K (100) | 27 | 80 | 97 |

EXAMPLE V

This example compares the effectiveness fo different halide salts in conjunction with the polysiloxane polyoxyalkylene copolymer Materials K and T. Samples were prepared and tested as referred to above, using as the distillate fuel a commercial vehicle fuel supplied as Esso diesel to which was added 0.1% by weight of the detergent additive used in Example III The amounts of the materials under evaluation which were added per million parts of fuel are shown in parenthesis in the Tables. The results are recited in Tables VII and VIII. From these Tables it can be seen that with this fuel, the haze was stable and cleared slowly in absence of a de-hazing agent. The haze cleared most quickly and to a greater extent from the samples containing the halide salt—siloxane mixtures. Using the magnesium salts and Material T, the chloride was more effective than the bromide which in turn was more effective than the nitrate. Using the quaternary ammonium salts and Material K, the Material having four Me groups was more effective than that having three Me groups which in turn was more effective than that having one Me group.

TABLE VII

| Test | Material Added | Percentage Light Transmittance After | | | |
|---|---|---|---|---|---|
| | | 0 | 24 | 48 | 96 hours |
| 43 | None | 19 | 17 | 25 | 30 |
| 44 | T (100) A (100) | 21 | 73 | 87 | 98 |
| 45 | T (100) B (100) | 19 | 71 | 84 | 94 |
| 46 | T (100) C (100) | 16 | 21 | 24 | 54 |

TABLE VIII

| Test | Material Added | Percentage Light Transmittance After | | |
|---|---|---|---|---|
| | | 0 | 96 | 120 hours |
| 47 | None | 23 | 39 | 49 |
| 48 | K (100) | 24 | 33 | 36 |
| 49 | D (100) | 25 | 77 | 88 |
| 50 | E (100) | 23 | 31 | 37 |
| 51 | F (100) | 22 | 39 | 43 |
| 52 | K (100) D (100) | 27 | 87 | 97 |
| 53 | K (100) E (100) | 23 | 37 | 42 |
| 54 | K (100) F (100) | 22 | 52 | 61 |

EXAMPLE VI

Samples were prepared and tested as referred to above, using as distillate fuel commecial vehicle fuels supplied (a) by Esso as 4 star petrol and (b) by Shell as 4 star petrol. The amounts of the materials under evaluation which were added per million parts of fuel are shown in parenthesis in Tables IX and X. In tests 56 and 58, the alcohol employed was ethylene glycol. The light transmittance was determined prior to addition of the de-hazing agent and after 0, 1, 2, 3 and 4 hours. The results are recited in Tables IX and X respectively.

From these Tables it can be seen that with these fuels the haze was cleared most quickly from samples treated in Tests 56 and 58.

TABLE IX

| | | Fuel (a) | | | | | |
|---|---|---|---|---|---|---|---|
| | | Percentage Light Transmittance After | | | | | |
| Test | Material Added | Initial | 0 | 1 | 2 | 3 | 4 hours |
| 55 | None | 22 | 30 | 52 | 64 | 68 | 76 |
| 56 | D (7)<br>I (3)<br>Ethylene glycol (90) | 22 | 50 | 86 | 96 | 97 | 100 |

TABLE X

| | | Fuel (b) | | | | | |
|---|---|---|---|---|---|---|---|
| | | Percentage Light Transmittance After | | | | | |
| Test | Material Added | Initial | 0 | 1 | 2 | 3 | 4 hours |
| 57 | None | 42 | 53 | 66 | 71 | 74 | 81 |
| 58 | D (7)<br>I (3)<br>Ethylene glycol (90) | 42 | 70 | 90 | 94 | 97 | 99 |

That which is claimed is:

1. A method of de-hazing distillate fuel which comprises adding to the fuel an effective amount for dehazing of a solution of a halide salt dissolved in an alcohol, and an alcohol soluble organosiloxane.

2. A method according to claim 1 wherein the halide salt is the chloride of magnesium, cadmium, copper, nickel or the tetra methyl ammonium group.

3. A method according to claim 2 wherein the salt has the formula $MgCl_2.6H_2O$ or $(CH_3)_4NCl$.

4. A method according to claim 1 wherein the organosiloxane comprises siloxane units having the general formula $$R_aSiO_{\frac{(3-a)}{2}} \quad \text{(i)}$$

in which each R represents a substituted or unsubstituted hydrocarbon group of up to ten carbon atoms, a has the value 0, 1, 2, or 3.

5. A method according to claim 1 wherein the organosiloxane comprises siloxane units having the general formula $$R_bZ_cSiO_{\frac{((3-(b+c))}{2}} \quad \text{(ii)}$$

in which each R represents a substituted or unsubstituted hydrocarbon group of up to ten carbon atoms, b has the value 0, 1 or 2, c has the value 1 or 2, and each Z represents a group linked to the silicon atom and comprising a functional organic group.

6. A method according to claim 5 wherein each Z is a group selected from the group consisting of the polyoxyalkylene group R' $(OCH_2CH_2)_p(OCH_2CH.CH_3)_rOR''$, the amine group R'NHQ, the quaternary ammonium salt $R'NR^2{}_3X$, the carboxylate group $R'CO_2M$, the sulphonate group $R'SO_3M$, or the hydroxyl group, in which R' represents a group which provides a link to the silicon atom through an oxygen or a carbon atom, p has a value in the range 1 to 100, r has a value in the range 0 to 50, the sum of p and q is in the range 2 to 100, R'' represents a hydrogen atom, an alkyl group or an acyl group, Q represents a hydrogen atom or a group R'NHQ, each $R^2$ represents an alkyl group, X represents a halide ion and each group M represents a cation.

7. A method according to claim 4 wherein the group R is an unsubstituted alkyl, aryl, alkaryl, aralkyl or cycloaliphatic group.

8. A method according to claim 5 wherein the group R is an unsubstituted alkyl, aryl, alkaryl, aralkyl or cycloaliphatic group.

9. A method according to claim 7 wherein not less than 80% of the groups R are methyl.

10. A method according to claim 8 wherein not less than 80% of the groups R are methyl.

11. A method according to claim 1 wherein the organosiloxane is a cyclic, linear or branched material comprising a major amount of siloxane units having the general formula in which each R represents a substituted or unsubstituted hydrocarbon group of up to ten carbon atoms, a has the value 0, 1, 2, or 3. and; a minor amount of siloxane units having the general formula $$R_aSiO_{\frac{(3-a)}{2}} \quad \text{(i)}$$

in which each R represents a substituted or unsubstituted hydrocarbon group of up to ten carbon atoms, a has the value 0, 1, 2, or 3 and; a minor amount os siloxane units having the general formula $$R_bZ_cSiO_{\frac{((3-(b+c))}{2}} \quad \text{(ii)}$$

in which each R represents a substituted or unsubstituted hydrocarbon group of up to ten carbon atoms, b has the value 0, 1 or 2, c has the value 1 or 2, and each Z represents a group linked to the silicon atom and comprising a functional organic group.

12. A method according to claim 1 wherien the organosiloxane is a polydimethylsiloxane, a block copolymer of an organosiloxane and a polyoxyalkylene glycol or a polydiorganosiloxane having quaternary amine groups.

13. A method according to claim 1 wherein the organosiloxane is added to the fuel in the same solution as the halide salt.

14. A distillate fuel oil when treated by a method according to claim 1.

15. A composition suitable for de-hazing distillate fuel comprising a solution in an aliphatic alcohol of an alcohol soluble halide salt, and an alcohol soluble organosiloxane.

16. A composition according to claim 15 wherein the halide salt is the chloride of magnesium, cadmium, copper, nickel or the tetra methyl ammonium group.

17. A composition according to claim 16 wherein the salt has the formula $MgCl_2.6H_2O$ or $(CH_3)_4NCl$.

18. A composition according to claim 15 wherein the organosiloxane comprises siloxane units having the general formula $$R_aSiO_{\frac{(3-a)}{2}} \quad \text{(i)}$$

in which each R represents a substituted or unsubstituted hydrocarbon group of up to ten carbon atoms and a has the value 0, 1, 2, or 3.

19. A composition according to claim 15 wherein the organosiloxane comprises siloxane units having the general formula $$R_bZ_cSiO_{\frac{(3-(b+c))}{2}} \quad \text{(ii)}$$

in which each R represents a substituted or unsubstituted hydrocarbon group of up to ten carbon atoms, b has the value 0, 1 or 2, c has the value 1 or 2, and each Z represents a group linked to the silicon atom and comprising a functional organic group.

20. A composition according to claim 19 wherein each Z is a group selected from the group consisting of the polyoxyalkylene group $R'(OCH_2CH_2)_p(OCH_2CH.CH_3)_rOR''$, the amine group $R'NHQ$, the quaternary ammonium salt $R'NR_3X$, the carboxylate group $R'CO_2M$, the sulphonate group $R'SO_3M$, or the hydroxyl group, in which R' represents a group which provides a link to the silicon atom through an oxygen or a carbon atom, p has a value in the range 1 to 100, r has a value in the range 0 to 50, the sum of p and q is in the range 2 to 100, R'' represents a hydrogen atom, an alkyl group or an acyl group, Q represents a hydrogen atom or a group $R'NHQ$ each $R^2$ represents an alkyl group, X represents a halide ion and each group M represents a cation.

21. A composition according to claim 18 wherein the group R is an unsubstituted alkyl, aryl, alkaryl, aralkyl or cycloaliphatic group.

22. A composition according to claim 19 wherein the group R is an unsubstituted alkyl, aryl, alkaryl, aralkyl or cycloaliphatic group.

23. A composition according to claim 21 wherein not less than 80% of the groups R are methyl.

24. A composition according to claim 22 wherein not less than 80% of the groups R are methyl.

25. A composition according to claim 15 wherein the organosiloxane is a cyclic, linear or branched material comprising a major amount of siloxane units having the general formula $$R_aSiO_{\frac{(3-a)}{2}} \quad \text{(i)}$$

in which each R represents a substituted or unsubstituted hydrocarbon group of up to ten carbon atoms, a has the value 0, 1, 2, or 3 and; a minor amount of siloxane units having the general formula $$R_bZ_cSiO_{\frac{((3-(b+c))}{2}} \quad \text{(ii)}$$

in which each R represents a substituted or unsubstituted hydrocarbon group of up to ten carbon atoms, b has the value 0, 1 or 2, c has the value 1 or 2, and each Z represents a group linked to the silicon atom and comprising a functional organic group.

26. A composition according to claim 15 wherein the organosiloxane is a polydimethylsiloxane, a block copolymer of an organosiloxane and a polyoxyalkylene glycol or a polydiorganosiloxane having quaternary amine groups.

27. A composition according to claim 15 wherein the alcohol is methanol or ethylene glycol.

* * * * *